US009506254B2

(12) United States Patent
Hilk

(10) Patent No.: US 9,506,254 B2
(45) Date of Patent: Nov. 29, 2016

(54) CERAMIC TILE AND METHOD OF MAKING AND USING THE SAME

(71) Applicant: Saint-Gobain Ceramics & Plastics, Inc., Worcester, MA (US)

(72) Inventor: Brian A. Hilk, Washington, PA (US)

(73) Assignee: SAINT-GOBAIN CERAMICS & PLASTICS, INC., Worcester, MA (US)

( * ) Notice: Subject to any disclaimer, the term of this patent is extended or adjusted under 35 U.S.C. 154(b) by 0 days.

(21) Appl. No.: 14/562,967

(22) Filed: Dec. 8, 2014

(65) Prior Publication Data

US 2015/0184396 A1 Jul. 2, 2015

Related U.S. Application Data

(60) Provisional application No. 61/920,958, filed on Dec. 26, 2013.

(51) Int. Cl.

| | |
|---|---|
| ***E04F 13/14*** | (2006.01) |
| ***E04F 13/08*** | (2006.01) |
| ***B28B 7/18*** | (2006.01) |

(52) U.S. Cl.

CPC ..... *E04F 13/142* (2013.01); *B28B 7/186* (2013.01); *E04F 13/0837* (2013.01); *Y10T 428/24273* (2015.01)

(58) Field of Classification Search

CPC ..... E04F 13/142; E04F 13/0833; E04F 13/0837; E04F 13/072; C04B 38/00

See application file for complete search history.

(56) References Cited

U.S. PATENT DOCUMENTS

| | | | | |
|---|---|---|---|---|
| 3,354,913 | A * | 11/1967 | Goto | B01J 19/02 138/142 |
| 3,624,344 | A | 11/1971 | Kutzer | |
| 3,747,291 | A | 7/1973 | Perigo et al. | |
| 4,137,681 | A | 2/1979 | Pasley | |
| 6,129,967 | A | 10/2000 | Young et al. | |

* cited by examiner

*Primary Examiner* — Patrick Maestri

(74) *Attorney, Agent, or Firm* — Abel Law Group, LLP; Robert N. Young

(57) ABSTRACT

A ceramic tile includes an opening that is used to help fasten the ceramic tile to a mounting object. The opening can have a relatively small width that can obviate the need for a cap and can allow for less abrading of a polymer compound that is exposed adjacent to a major surface of the ceramic tile. In an embodiment, an insert is placed into the opening in the ceramic tile, and the ceramic tile is fastened to a wall using a welding technique. In other embodiments, different shapes of openings and fastening techniques can be used.

20 Claims, 8 Drawing Sheets

CERAMIC TILE AND METHOD OF MAKING AND USING THE SAME

CROSS-REFERENCE TO RELATED APPLICATION

The present application claims priority to U.S. patent application No. 61/920,958, filed Dec. 26, 2013, entitled "Ceramic Tile and Method of Making and Using the Same", naming as an inventor Brian A. Hilk, which application is incorporated by reference herein in its entirety.

FIELD OF THE DISCLOSURE

The present disclosure is directed to ceramic tiles and methods of making and using such ceramic tiles.

BACKGROUND

Ceramic tiles can be used in a variety of applications. In some applications, the ceramic tiles may be installed in a structure, such as a grain elevator, that is subject to movement when in operation. Ceramic tiles may be attached to the structure using a mechanical fastener, a weld, or the like within an opening in the ceramic tile. The mechanical fastener includes a screw, a threaded stud, or the like, and a nut, an anchor, or the like that mates with such screw, threaded stud or the like. With respect to the weld, a cap can be attached to the ceramic tile with an adhesive, wherein the cap protects the weld. Further improvements with ceramic tiles are desired.

BRIEF DESCRIPTION OF THE DRAWINGS

Embodiments are illustrated by way of example and are not limited in the accompanying figures.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the ceramic arts.

A ceramic tile can include a relatively small opening extending through the ceramic tile to allow such ceramic tile to be installed using a fastener that can be used for a longer period before such mechanical fastener would fail or otherwise need to be replaced. Thus, the ceramic tile does not have problems associated with a cap that would otherwise be used with the ceramic tile or too much abrasion of a polymeric compound when a ceramic tile has a relatively large opening.

Figure 1:
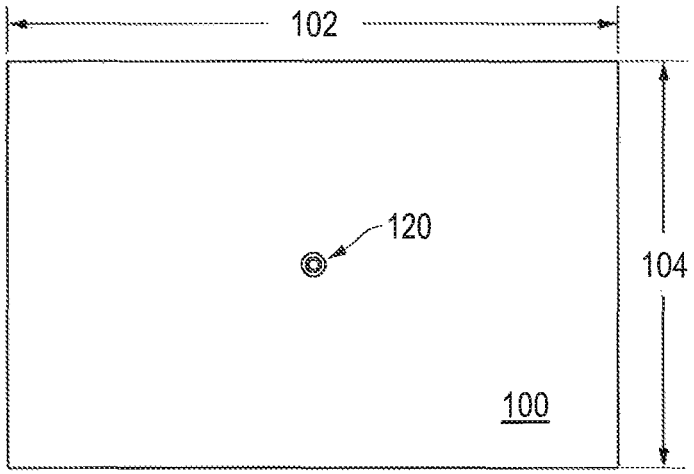
FIGS. 1 and 2 include an illustration of a top view and a cross-sectional view, respectively, of a ceramic tile in accordance with an embodiment.
Figure 2:
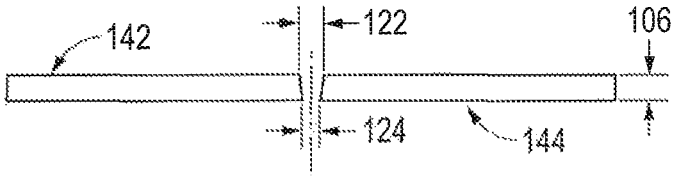

FIGS. 1 and 2 include illustrations of a top view and a cross-sectional view, respectively, of a ceramic tile 100 in according with an embodiment. In the embodiment as illustrated, the ceramic tile 100 has a rectangular shape. In another embodiment, a different shape including a triangle, a square, a hexagon, an octagon, or other polygonal shape may be used. The polygon may have sides of equal or different lengths or widths. In another embodiment, the ceramic tile can have a circular or ellipsoidal shape. As illustrated, the ceramic tile 100 has opposing major surfaces 142 and 144 that are generally parallel to each other and can lie flat. In an alternative embodiment, the ceramic tile can have a curved surface, and in a particular embodiment, can form part of a cylindrical shape. Thus, the ceramic tile 100 can have a shape in a form of a planar tile, a curved tile, a pyramid, or a cone. Other shapes may be used.

In the embodiment as illustrated in FIGS. 1 and 2, the ceramic tile 100 has a length 102, a width 104, and a thickness 106, wherein length>width>thickness. In an embodiment, the length 102 is at least 1.2 cm (0.5 inch) at least 2.5 cm (1 inch), at least 5.0 cm (2 inches), at least 10 cm (4 inches), or at least 15 cm (6 inches), and in another embodiment, the length 102 may be no greater than 30 cm (12 inches), no greater than 25 cm (10 inches), or no greater than 20 cm (8 inches). In an embodiment, the width 104 is at least 1.2 cm (0.5 inch), at least 2.0 cm (0.8 inches), at least 3.0 cm (1.2 inches), or at least 4.0 cm (1.5 inches), and in another embodiment, the width 104 may be no greater than 30 cm (12 inches), no greater than 25 cm (10 inches), or no greater than 20 cm (8 inches), no greater than 10 cm (4 inches), no greater than 9 cm (3.5 inches), or no greater than 7 cm (2.8 inches). For a square, the length and width are equal, for a circle, the diameter is the same as the width (and length), and for an ellipsoid, the length corresponds to a major axis, and the width corresponds to a minor axis. In another embodiment, the thickness 106 is no greater than 1.3 cm (0.5 inch), no greater than 0.95 cm (0.4 inch), no greater than 0.80 cm (0.3 inch), or no greater than 0.70 cm (0.27 inch), and in another embodiment, the thickness 106 is at least 0.20 cm (0.08 inch), at least 0.30 cm (0.12 inch), and at least 0.60 cm (0.24 inch).

As illustrated, the ceramic tile 100 has an opening 120 extending through the ceramic tile 100. From the top view, the opening 120 can be at or near the center of ceramic tile 100. In another embodiment, the opening 120 can be at a location spaced away from the center of the ceramic tile 100. In a further embodiment, more than one opening may be used and can be spaced apart from each other. The opening 120 can be sized sufficient large to allow an insert to be placed into the opening 120, but not so large that a nut, screw having a head, or another similar object can be used in the opening can be used with the insert or another similar object. If such combinations of objects were to be placed into an opening extending through the ceramic tile, such opening would have a width of at least 1.3 cm (0.5 inches). Such a wide opening would have problems as described later in this specification. By keeping the width of the opening 120 at the major surface 142 sufficiently small, such problems may be obviated.

Figure 3:
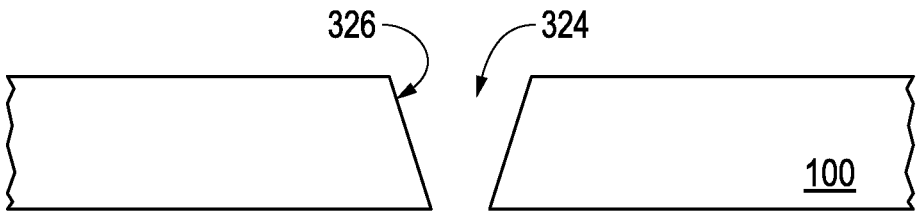
FIG. 3 includes an illustration of a cross-sectional view of an enlarged portion of the ceramic tile of FIGS. 1 and 2.
Figure 4:
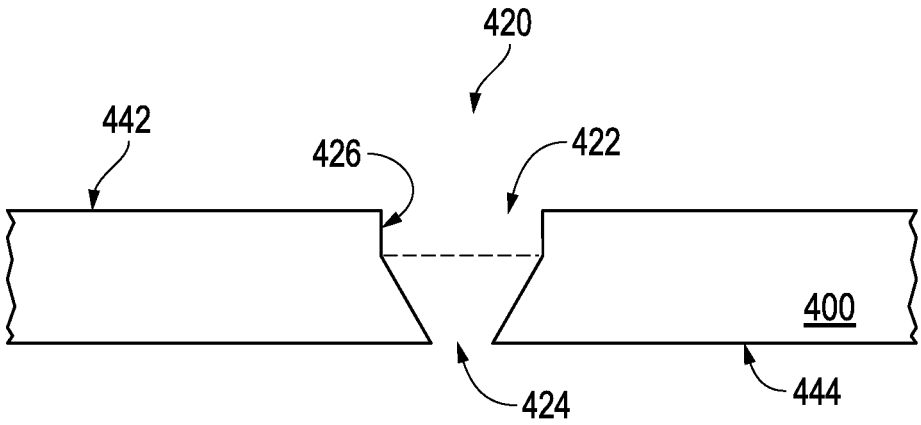
FIG. 4 includes an illustration of a cross-sectional view of a portion of a ceramic tile in accordance with another embodiment.

In a particular embodiment as illustrated in FIG. 3, the opening 120 extends through the entire thickness of the ceramic tile 100 and has a sidewall 326 that includes a tapered portion 324. In an embodiment, the tapered portion 324 of the opening 120 extends along the entire depth of the opening 120. In another embodiment as illustrated in FIG. 4, a ceramic tile 400 has an opening 420 that extends between the major surfaces 442 and 444. A tapered portion 424 extends only partly through the depth of the opening 420, and other portion 422 may be straight and have a sidewall 426 that lies along a plane that is substantially perpendicular to planes corresponding to either or both of the major surfaces 442 and 444 of the ceramic tile 400. In an embodiment, the straight portion 422 may be adjacent to the wider end of the tapered portion 424. In a particular embodiment, the tapered portion 424 can extend over a greater depth of the opening as compared to the straight portion 422.

In an embodiment, the opening 120 may have a maximum width of no greater than 1.15 cm (0.45 inches), no greater than 0.90 cm (0.35 inches), no greater than 0.80 cm (0.31 inches), or no greater than 0.70 cm (0.28 inches), and in another embodiment, the maximum width can be at least 0.30 cm (0.12 inches), at least 0.40 cm (0.16 inches), at least 0.50 (0.20 inches) cm. In a particular embodiment, the opening 120 can have a maximum width in a range of 0.30 cm (0.12 inch) to 0.90 cm (0.35 inch), 0.40 cm (0.16 inch) to 0.80 cm (0.31 inch), or 0.50 (0.20 inch) to 0.70 cm (0.28 inch). The tapered portion of the opening 120 provides a minimum width that is smaller than the maximum width. In an embodiment, the opening 120 may have a minimum width of no greater than 0.80 cm (0.31 inch), no greater than 0.70 cm (0.28 inch), or no greater than 0.60 (0.24 inch) cm, and in another embodiment, the minimum width can be at least 0.20 cm (0.08 inch), at least 0.30 cm (0.12 inch), at least 0.40 cm (0.16 inch). In a particular embodiment, the opening 120 has a minimum width in a range of 0.20 cm (0.08 inch) to 0.80 cm (0.31 inch), 0.30 cm (0.12 inch) to 0.70 cm (0.28 inch), or 0.40 cm (0.16 inch) to 0.60 cm (0.24 inch). The tapered portion 324 of the opening 120 can have an angle that is defined by an intersection of a line along the sidewall surface of the tapered portion of the opening 120 and the centerline of the opening 120. The angle can be less than 40°, less than 30°, or less than 15°, and in another embodiment, the angle can be at least 4°, at least 5°, at least 7°, at least 9°, or at least 10°. In a particular embodiment, the angle is in a range of 4° to 30°, 5° to 20°, or 9° to 15°.

The opening 420 can have any of the dimensions as described with respect to the opening 120. The other portion 422 can have any of the dimensions as described with respect to the maximum width of the opening 120. The other portion 422 is contiguous with the major surface 442 and can extend to 50% of the depth of the opening 420, no greater than 40% of the depth of the opening 420, or no greater than 30% of the depth of the opening 420.

A ceramic tile 100 or 400 can have a plurality of openings instead of one opening. The plurality of openings can have the any of the dimensions as previously described. The openings within the plurality of openings can be substantially identical or at least one opening can be different from another opening.

Figure 5:
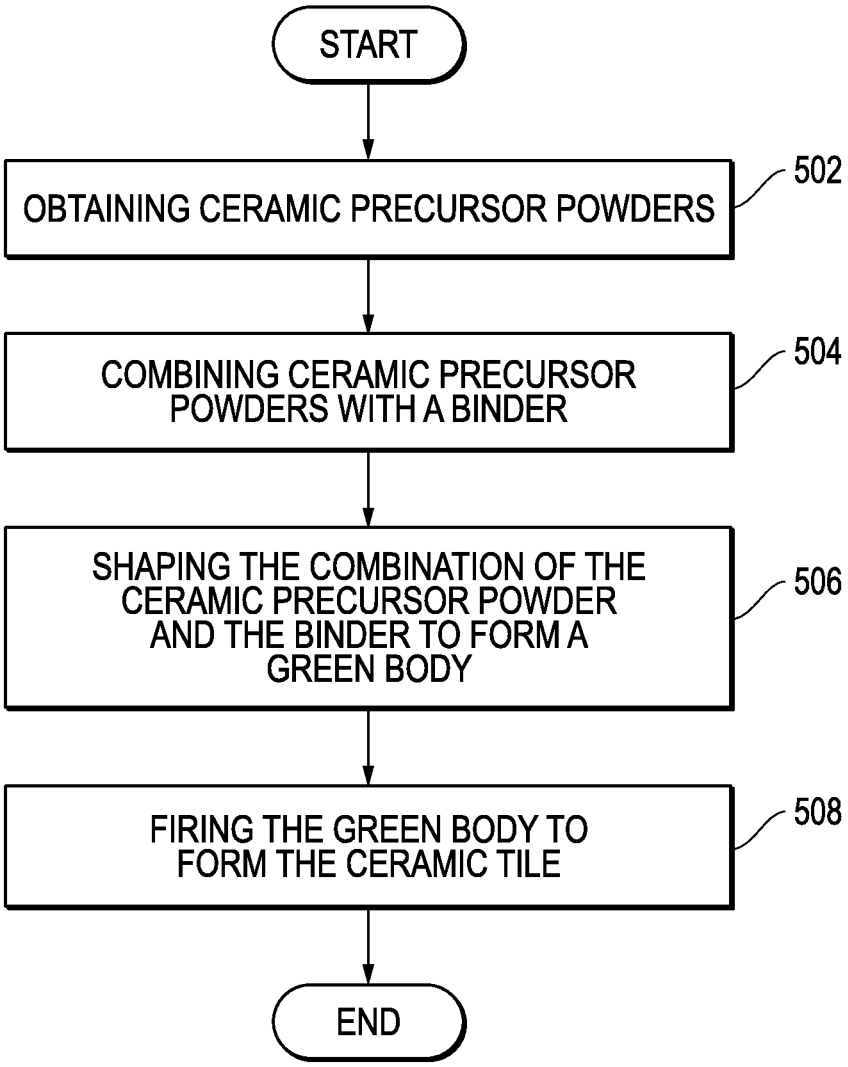
FIG. 5 includes a flow chart for a process of making a ceramic tile.

The ceramic tile 100 or 400 can be formed as described with respect to the process flow in FIG. 5. The process includes obtaining ceramic precursor powders, at block 502. The ceramic tile 100 or 400 can include one or more different oxides, nitrides, or carbides. As used herein, the composition of the ceramic tile 100 or 400 can be expressed in terms of single metal oxides, nitrides, or carbides. For example, a mullite can be expressed as being about 67 wt % $Al_2O_3$ and about 33% $SiO_2$. The ceramic tile 100 or 400 can be formed from a number of starting materials. In a non-limiting embodiment, the ceramic tile can include at least at least 50 wt %, at least 65 wt %, or at least 80 wt % of $Al_2O_3$, $SiO_2$, $ZrO_2$, SiC, or any combination thereof, which is referred to herein as a principal component. In a particular embodiment, the ceramic tile includes at least 80 wt % of $Al_2O_3$, at least 80 wt % of $Al_2O_3$, at least 90 wt % of $Al_2O_3$, or at least 95 wt % of $Al_2O_3$, and in another particular embodiment, the ceramic tile 100 includes less than 99.8 wt % $Al_2O_3$.

In an embodiment, the principal component is in the form of a powder having particles with a median particle size no greater than approximately 100 microns, a median particle size no greater than approximately 30 microns, a median particle size no greater than approximately 20 microns, or a median particle size no greater than approximately 15 microns. In another embodiment, the median particle size is at least approximately 0.5 microns, at least approximately 1.0 microns, or at least approximately 5.0 microns.

In an embodiment, a combination of principal component powders having different particle sizes can be used, wherein the principal component powders have the same composition (for example, $Al_2O_3$) or different compositions (for example, $Al_2O_3$ and $SiO_2$). The number of different sized principal component powders can be two, three, four, or more. In a particular embodiment, principal component powders having two different particle sizes are used. In a more particular embodiment, one of the principal powders can have a median particle size that is less than approximately 50%, less than approximately 40%, or less than approximately 30% of the median particle size of the other principal component powder. To illustrate, one of the principal component powders can have a nominal particle size of 2 microns, and the other principal component powder can have a nominal particle size of 10 microns. The principal component powders of different particle sizes can be mixed in any ratio. For example, principal component powders having two different particle sizes can be mixed in a ratio of approximately 1:99, approximately 2:98, approximately 3:97, approximately 10:90, approximately 20:80, approximately 50:50, approximately 80:20, approximately 90:10, approximately 97:3, approximately 98:2, or approximately 99:1. Likewise, mixture of principal component powders having three or more different sizes can be prepared in a particular ratio.

In an embodiment, the principal component can be provided as a reactive principal component, a non-reactive principal component, or any combination thereof. The reactive principal component can help to increase the density and reduce the porosity of the ceramic tile 100 or 400. As used herein, "reactive principal component" is intended to mean that the particular principal component powder has a surface area of at least two square meters per gram ($\geq 2$ $m^2/g$), and, "non-reactive principal component" is intended to mean that the particular principal component powder has a surface area less than two square meters per gram ($<2$ $m^2/g$). In an embodiment, the amount of reactive principal component, as a fraction of total principal component powder used to form the ceramic tile 100 or 400 can include at least approximately 1% and may be up to 100% of the total principal component powder used. A combination of reactive principal component and non-reactive principal component powders can be used. In a particular embodiment, at least approximately 2%, at least approximately 5%, at least approximately 16%, at least approximately 25%, or at least approximately 50% of the principal component used in forming the ceramic tile 100 can be provided as reactive principal component. In another embodiment, no greater than approximately 95%, no greater than approximately 90%, no greater than approximately 75%, no greater than approximately 60%, or no greater than approximately 50% of the principal component used in forming the ceramic tile 100 is provided as reactive principal component.

The starting materials for the ceramic tile 100 or 400 can also include one or more additives. In an embodiment, the ceramic tile 100 or 400 includes at least 0.1 wt % of an additive, at least 0.4 wt % of the additive, or at least approximately 0.6 wt % of the one or more additives, and in another embodiment, the ceramic tile 100 or 400 includes no greater than 8 wt % of an additive, no greater than approximately 7 wt % of the additive, or no greater than approximately 6 wt % of the one or more additives. The one or mode additives can be provided as an oxide, a carbide, a carbonate, a nitrate, a sulfate, a halide, a phosphate, or any combination thereof. In an embodiment, the additives can be provided in a substantially pure form with trace amounts of impurities. In another embodiment, one or more additives can be provided as a compound. For example, MgO and $TiO_2$ can be provided as an $MgTiO_3$ compound.

In a particular embodiment, at least a portion of the one or more additives can be provided as a powder. In a more particular embodiment, the powder may be in the form of particles having a median particle size no greater than approximately 30 microns, no greater than approximately 20 microns, or no greater than approximately 15 microns. In another embodiment, the median particle size is at least approximately 0.1 micron, at least approximately 0.5 micron, or at least approximately 1 micron.

In an embodiment, at least a portion of a particular additive can be a sintering agent. In a particular example, the sintering agent can help to reduce porosity by lowering a melting temperature of $SiO_2$ used to make the ceramic tile 100 or 400 and allowing $SiO_2$ to be disposed within pores of the ceramic tile 100. An exemplary sintering agent can include Ta, Ti, Fe, Mg, Zn, another suitable sintering agent, or any combination thereof. In an illustrative embodiment, additives provided as sintering agents can be provided as oxides.

In another embodiment, at least a portion of a particular additive can be added to react with $SiO_2$ to prevent Al from reacting with the $SiO_2$, when the principal component includes $Al_2O_3$. In particular, Mg, Ca, Ba, Sr, Y, or any combination thereof, can be added to react with $SiO_2$ rather than Al that is provided as a ceramic precursor powders. After the ceramic precursor powders are obtained with the proper compositions, particle sizes, and amounts, the ceramic precursor powders can be thoroughly mixed.

The process can continue with combining the ceramic precursor powders with an additional material that can be used to form the ceramic tile 100 or 400, at block 504. Such an additional material can include a binder, a solvent, a dispersant, a thickener, a deflocculant, another suitable ingredient, or any combination thereof. In an embodiment, the additional material can include non-metallic compounds. In another embodiment, the additional material can include an organic compound, water, or the like. When the additional material includes a binder, the binder can include a resin, a polymeric compound, or another suitable organic compound that can be used a binder.

The process can further include shaping the combination of the ceramic precursor powder and binder to form a green body, at block 506. The shapes of the green body can be any of the shapes as previously described with respect to the ceramic tile 100. With respect to length, in an embodiment, the green body has a length>width>thickness, wherein the length is at least 2.5 cm (1 inch), at least 5.0 cm (2 inches), at least 10 cm (4 inches), or at least 15 cm (6 inches), and in another embodiment, the green body has a length>width>thickness, wherein the length is no greater than 30 cm (12 inches), no greater than 25 cm (10 inches), or no greater than 20 cm (8 inches). With respect to width, in an embodiment, the green body has a length≥width>thickness, wherein the width is at least 1.2 cm (0.5 inch), at least 2.0 cm (0.8 inch), at least 3.0 cm (1.2 inches), or at least 4.0 cm (1.6 inches), and in another embodiment, the green body has a length≥width>thickness, wherein the width is no greater than 10 cm (4 inches), no greater than 9 cm (3.5 inches), or no greater than 7 cm (2.8 inches). With respect to thickness, the green body has a thickness no greater than 1.3 cm (0.5 inch), no greater than 0.95 cm (0.37 inch), no greater than 0.80 cm (0.31 inch), or no greater than 0.70 cm (0.28 inch), and in another embodiment, the green body has a thickness of at least 0.20 cm (0.08 inch), at least 0.30 cm (0.12 inch), and at least 0.60 cm (0.24 inch).

An opening in the green body can be formed and correspond to the opening 120 of the ceramic tile 100 or the opening 420 of the ceramic tile 400. The opening in the green body can be formed as part of the shaping operation. In a non-limiting embodiment, shaping, including formation of the opening, can be formed by a mould using a die pressing operation. In another embodiment, the opening can be formed by removing a portion of the green body after shaping. The removal can be formed by punching a hole in the green body, but cutting the green body to form the hole, or another similar operation. After reading this specification, skilled artisans will be able to determine how to form the opening in the green body.

The opening in the green body can have any of the shapes as previously described with respect to the opening 120 or opening 420. Thus, the opening in the green body can have a sidewall includes a tapered portion. In a particular embodiment, the opening extends through the entire thickness of the green body and has a sidewall that includes a tapered portion. In an embodiment, the tapered portion of the opening extends along the entire depth of the opening, corresponding to opening 120, and in another embodiment, the tapered portion extends only partly through the depth of the opening, and other portion may be straight and have a sidewall that lies along a plane that is substantially perpendicular to planes corresponding to the major surfaces of the green body, corresponding to opening 420. In an embodiment, the straight portion may be adjacent to the wider end of the tapered portion. In a particular embodiment, the tapered portion can extend over a greater depth of the opening as compared to the straight portion.

In an embodiment, the opening in the green body may have a maximum width of no greater than 1.15 cm (0.45 inch), no greater than 0.90 cm (0.35 inch), no greater than 0.80 cm (0.31 inch), or no greater than 0.70 cm (0.28 inch), and in another embodiment, the maximum width can be at least 0.30 cm (0.12 inch), at least 0.40 cm (0.16 inch), at least 0.50 cm (0.20 inch). In a particular embodiment, the opening can have a maximum width in a range of 0.30 cm (0.12 inch) to 0.90 cm (0.35 inch), 0.40 cm (0.16 inch) to 0.80 cm (0.31 inch), or 0.50 cm (0.20 inch) to 0.70 cm (0.28 inch). The tapered portion of the opening provides a minimum width that is smaller than the maximum width. In an embodiment, the opening may have a minimum width of no greater than 0.80 cm (0.31 inch), no greater than 0.70 cm (0.28 inch), or no greater than 0.60 (0.24 inch) cm, and in another embodiment, the minimum width can be at least 0.20 cm (0.08 inch), at least 0.30 cm (0.12 inch), at least 0.40 cm (0.16 inch). In a particular embodiment, the opening has a minimum width in a range of 0.20 cm (0.08 inch) to 0.80 cm (0.31 inch), 0.30 cm (0.12 inch) to 0.70 cm (0.28 inch), or 0.40 cm (0.16 inch) to 0.60 cm (0.24 inch). The opening can have an angle that is defined by an intersection of a line along the sidewall surface of the tapered portion of the opening and the centerline of the opening. The angle can be less than 40°, less than 30°, or less than 15°, and in another embodiment, the angle can be at least 7°, at least 9°, or at least 10°. In a particular embodiment, the angle is in a range of 7° to 30°, 9° to 20°, or 10° to 15°.

A green body can have a plurality of openings instead of one opening. The plurality of openings can have the any of the dimensions as previously described. The openings within the plurality of openings can be substantially identical or at least one opening can be different from another opening.

The process can further include firing the green body to form the ceramic tile 100 or 400, at block 508 in FIG. 5. The green body can be heated in an oven, heater, furnace, or the like. The heating process can include an initial heating where moisture, a solvent, or another volatile component is evaporated, organic material is vaporized, or any combination thereof. The initial heating can be conducted at a temperature in a range of approximately 100° C. to approximately 300° C. for a time period in a range of approximately 10 hours to approximately 200 hours. Following the initial heating, the sintering can be performed at a temperature in a range of approximately 1400° C. to 1700° C. for a time period in a range of approximately 10 hours to approximately 100 hours to form the ceramic tile 100.

The shape of the ceramic tile 100 or 400 generally corresponds to the shape of the green body. Thus, the ceramic tile 100 or 400 may have any of the shapes as previously described with respect to the green body. During sintering, some shrinkage may occur, and the ceramic tile 100 or 400 may be smaller than the green body. Thus, although many dimensions for the ceramic tile 100 or 400 and opening 120 or 420 overlap with the green body and opening in the green body, the ceramic tile 100 or 400 will have dimensions that are less than corresponding dimensions of the green body, and the opening 120 or 420 will have dimensions that are greater than corresponding dimensions of the opening in the green body.

A percentage of the theoretical density ("Th.D") of the ceramic tile 100 or 400 can be measured. In an embodiment, the percentage of the theoretical density of the ceramic tile 100 or 400 may be no greater than approximately 98%, no greater than approximately 97%, or no greater than approximately 96%. In another embodiment, the percentage of the theoretical density of the ceramic tile 100 can be at least approximately 91%, at least approximately 92%, or at least approximately 93%. The theoretical density as referred to herein is the density a sample would have if its porosity (open and closed) was equal to 0. The percentage of theoretical density for a given sample can be calculated from the ratio of its density ("D") over its theoretical density as shown in Equation 1:

$$(D/Th.D)\times 100=\%\ Th.D \qquad \text{(Eq. 1)}$$

When the ceramic tile 100 or 400 includes a number of oxides, the theoretical density of a ceramic tile 100 can be calculated based on the chemical composition of the mix of oxides included in the ceramic block as shown in Equation 2:

$$W_{dry}/[W_{Ox1}/Th.D_{Ox1}+W_{Ox2}/Th.D_{Ox2}+\ldots+W_{Oxn}/Th.D_{Oxn}]=Th.D \qquad \text{(Eq. 2)}$$

where, $W_{dry}$ is a dry weight of the mix of oxides, $W_{Ox}$ is a weight of a particular oxide, and $Th.D_{Ox}$ is the theoretical density of a particular oxide.

Additionally, density as referred to herein is the ratio between the measured weight of a sample of a ceramic tile and its volume without the open porosity. The volume is measured by immersion of the sample into water having a density $d_{Liq}$. This method can be referred to as the immersion density method or Archimedes method and comprises the following steps: (1) samples are vacuumed to eliminate air and adsorbed water from the surface and from open pores (2) samples are immersed in water to fill up open pores (3) the weight of the samples is measured ($W_{imm}$) immersed in water (4) samples are removed from the liquid and the surface is wiped prior to measuring the weight of samples in air this time ($W_{wet}$) (5) samples are dried and their weight is measured ($W_{dry}$). Equations 3 and 4 shown below can be used to calculate the density of the sample.

$$(W_{dry}-W_{imm})/d_{Liq}=V(\text{volume of sample}) \quad \text{(Eq. 3)}$$

$$W_{dry}/V=D \quad \text{(Eq. 4)}$$

Further, the apparent porosity of the ceramic tile 100 or 400 can be measured. In a particular embodiment, the apparent porosity of the ceramic tile 100 or 400 may be no greater than approximately 1.0 vol %, no greater than approximately 0.8 vol %, no greater than approximately 0.5 vol %, or no greater than approximately 0.2 vol %. Open (or apparent) porosity as used herein is the volume of porosity that is accessible (i.e. the volume that can be filled). Apparent porosity is expressed herein as a percentage of total volume as shown by Equation 5, where the volume of the pores ($V_{poro}$) is calculated according to Equation 6:

$$(V_{Poro}/V)\times 100=\%\ Poro \quad \text{(Eq. 5)}$$

$$(W_{wet}-W_{dry})/d_{Liq}=V_{Poro} \quad \text{(Eq. 6)}$$

The ceramic tile 100 or 400 can include grains having a median size no greater than approximately 500 microns, no greater than approximately 300 microns, or no greater than approximately 110 microns. In another embodiment, the grains of the ceramic tile 100 can include grains having a median size of at least approximately 10 microns, at least approximately 30 microns, or at least approximately 50 microns. The grain size is estimated from the observation of polished sections of the ceramic tile 100 or 400 and the measurement of the length (maximum dimension) and width (minimum dimension) of a large number of single grains (at least 100 grains randomly chosen). The average grain size can be determined using the widths, lengths, or a combination thereof, for example an average of the average width and average length (i.e., (average width+average length)/2) of the grains. In an embodiment, the average grain size can be based on an average of widths of the grains, an average of lengths of the grains, a median value corresponding to the width or the length, or the like. When comparing grain sizes, lengths of a sample are compared to the lengths of another sample or a prior art composition, widths of a sample are compared to the widths of another sample or a prior art composition, and a median value for grains of a sample are to be compared to the median values for grains of another sample or a prior art composition.

In another embodiment, size distributions can be determined from the data collected on the grains as previously described with respect to the average lengths and widths. As used herein, a D10 value represents the $10^{th}$ percentile, a D50 value represents the $50^{th}$ percentile, and a D90 value represents the $90^{th}$ percentile. Thus, D50 corresponds to the median value. In an embodiment where length is used as the basis of grain size, the D10, the D50 value, the D90 value, or a combination thereof, for the size of the grains of the ceramic tile 100 or 400 may be no greater than approximately 450 microns, no greater than approximately 300 microns, or no greater than approximately 150 microns. In an additional embodiment where length is used as the basis of grain size, the D10, the D50 value, the D90 value, or a combination thereof, for the size of the grains of the ceramic tile 100 or 400 is at least approximately 5 microns, at least approximately 20 microns, or at least approximately 50 microns.

The distribution of grain sizes within the sintered ceramic material can have a single mode or a plurality of modes, such as two, three, four, etc. In an embodiment, the sintered ceramic material can have a bimodal distribution of average grain sizes. In a particular embodiment, one of the modes can have a median grain size that is less than approximately 50%, less than approximately 40%, or less than approximately 30% of the average grain size of the other mode.

Furthermore, the ceramic tile 100 can have one or more phases, such as an aluminum phase and a silica phase. In a particular embodiment, substantially all of the aluminum of the ceramic tile 100 or 400 can be disposed in the aluminum phase. In another embodiment, when the ceramic tile 100 or 400 includes one or more additives, any one or more of the additives can be disposed within each of the aluminum phase and the silica phase. In an additional embodiment, substantially all of any one or more of the additives of the ceramic tile 100 or 400 can be disposed outside of the aluminum phase. In a more particular embodiment, substantially all of any one or more of the additives can be disposed within the silica phase. In a further embodiment, the silica phase is substantially uniformly dispersed throughout the aluminum phase within a body portion of the ceramic tile 100. In still another embodiment, the ceramic tile 100 or 400 includes a peripheral region disposed between an edge of the ceramic tile 100 or 400 and the body portion and outside of the body portion, where any portion of the peripheral region may be within no greater than approximately 20 mm of an edge of the ceramic tile 100 or 400, no greater than approximately 10 mm of the edge of the ceramic tile, no greater than approximately 5 mm of the edge of the ceramic tile, or no greater than approximately 1 mm of the edge of the ceramic tile 100 or 400.

In needed or desired, the opening 120 or 420 may be formed after the ceramic tile 100 or 400 is fired instead of forming the corresponding opening in the green body.

Figure 6:
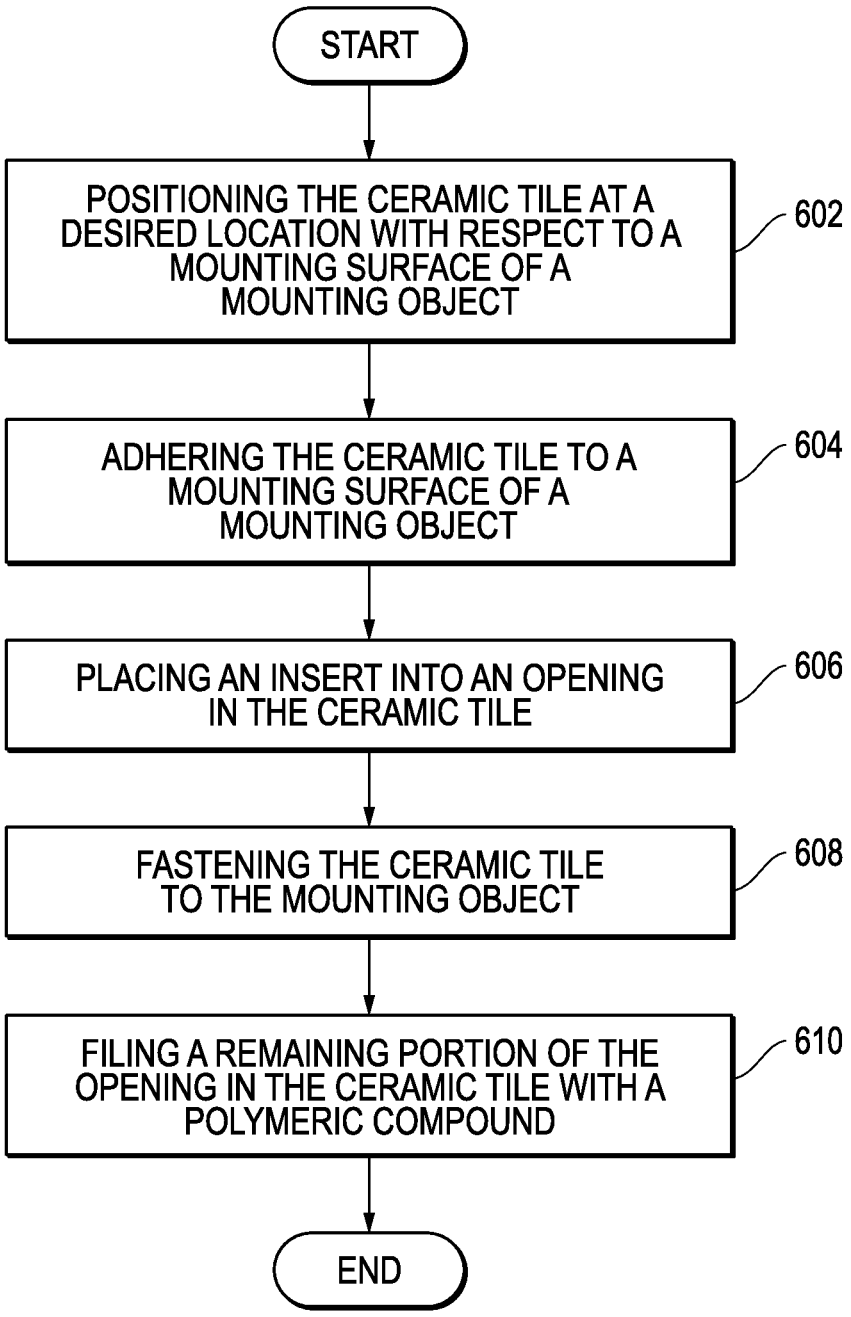
FIG. 6 includes a flow chart for a method of installing a ceramic tile.

The ceramic tile 100 or 400 can be used for a desired application. FIG. 6 includes a flow diagram for a method of installing the ceramic tile in accordance with an embodiment. The method includes positioning the ceramic tile at a desired location with respect to a mounting surface of a mounting object, at block 602. The ceramic tile can be used to line a chute, ductwork, or another suitable object through which particles will flow to protect a wall of such chute, ductwork, or other suitable object. Thus, the mounting object can be the chute, ductwork, or other suitable object, and the mounting surface can be the wall of the chute, ductwork, or other suitable object.

Figure 7:
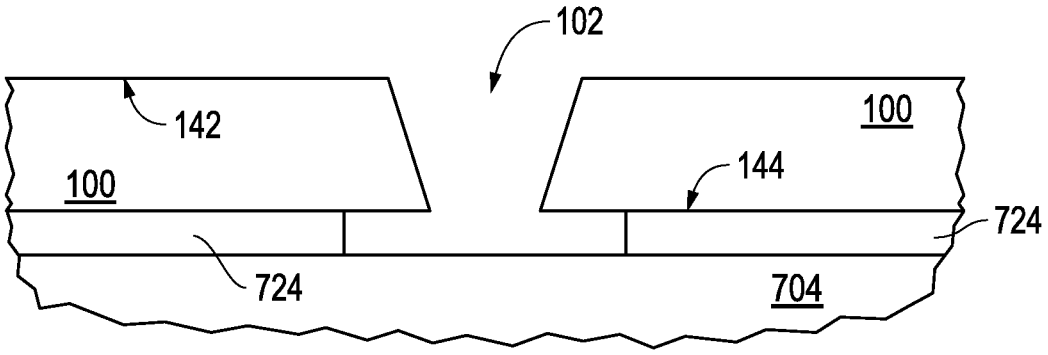
FIG. 7 includes an illustration of a cross-sectional view of the ceramic tile after adhering the ceramic tile to a mounting object.

In a particular embodiment as illustrated in FIGS. 7 to 10, the ceramic tile 100 is attached to a wall by a combination of an adhesive and a fastener. While the embodiment is described with respect to the ceramic tile 100, the method may also be used for the ceramic tile 400. After the ceramic tile 100 is positioned at the desired location, the ceramic tile 100 is adhered to the mounting surface of the mounting object, at block 602 in FIG. 6. In a particular embodiment, the mounting surface is the surface of the wall 704 as illustrated in FIG. 7. The ceramic tile 100 is installed such that the major surface 142 faces away from the wall 704, and the major surface 144 faces the wall 704. An adhesive layer 724 is applied to a surface of the wall 706, the major surface 144 of the ceramic tile 100, or both. The adhesive layer 724 can include an epoxy, a rubber compound, a double sided film, or the like. If static charge build-up is a concern, carbon or a metal (for example, silver filled epoxy or z-axis conductors within an interposer with an adhesive compound along both sides of the interposer) can be included within the adhesive layer 724 to form an electrically conductive or electrically resistive path between the wall 704 and the ceramic tile 100.

In one embodiment, the adhesive layer 724 does not underlie the opening 120, and in another embodiment, the adhesive layer 724 underlies at least part or all of the opening 120. The location of the adhesive layer 724 relative to the opening may in part depend on how the ceramic tile 100 will be fastened to the wall 704. For example, if the ceramic tile 100 is fastened using a welding technique, the adhesive layer 724 may not be present along the wall 704 where welding will occur. In such an application, the adhesive layer 724 may not be formed where the opening 120 in the ceramic tile 100 will be located, or the adhesive layer 724 may be formed along the wall 724 and a portion of the adhesive layer 724 corresponding to a location adjacent to the opening 120 will be removed before or after the ceramic tile 100 is adhered to the wall 724. If a mechanical fastener is used, part of the mechanical fastener may be able to pierce the adhesive layer 724, and therefore, the adhesive layer 724 may not need to be removed below the opening 120.

In an embodiment, the thickness of the adhesive layer 724 is at least 0.05 mm, at least 0.11 mm, or at least 0.2 mm, and in another embodiment, is no greater than 3.0 mm, no greater than 2.0 mm, or no greater than 0.9 mm. In a particular embodiment, the thickness is in a range of 0.05 mm to 3.0 mm, 0.11 mm to 2.0 mm, or 0.2 mm to 0.9 mm. In one embodiment, the adhesive layer 724 does not underlie the opening 120, and in another embodiment, the adhesive layer 724 underlies at least part or all of the opening 120. The location of the adhesive layer 724 relative to the opening may in part depend on how the ceramic tile 100 will be fastened to the wall 704.

The method can further include placing an insert in an opening in the ceramic tile, at block 606 in FIG. 6. Many different inserts and fastening techniques may be used. A particular insert and fastening technique is described below before addressing other inserts and fastening techniques.

Figure 8:
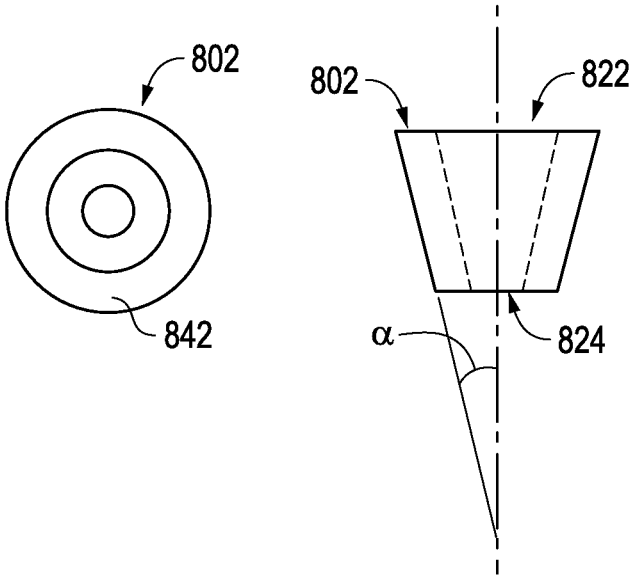
FIG. 8 includes an illustration of a cross-sectional view of an insert in accordance with an embodiment.

In an embodiment as illustrated in FIG. 8, an insert 802 can be used within the opening 120. The insert 802 can help to secure the ceramic tile 100 when a combination of the insert 802 and the ceramic tile 100 are installed. The insert 802 can spread forces when installing and retaining the ceramic tile over an area of the opening 120. An outer surface of the insert 802 can complement the inner surface within the tapered portion of the opening. The insert 802 can include a relatively thermally conductive material as compared to the ceramic tile 100. Thus, the insert 802 can help to reduce a thermal gradient when the ceramic tile 100 is fastened to a wall with a weld, as compared to welding the ceramic tile 100 to the wall without the insert. The lower thermal gradient can help reduce the likelihood of fracturing the ceramic tile 100 during welding.

Figure 9:
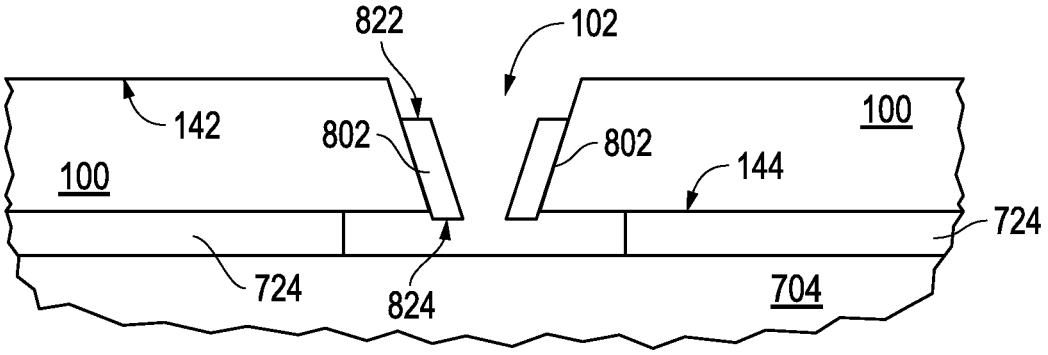
FIG. 9 includes an illustration of a cross-sectional view of the ceramic tile and the mounting object of FIG. 7 after placing the insert of FIG. 8 within an opening of the ceramic tile.

In the embodiment as illustrated in FIG. 9, the insert 802 is tapered along its entire length and has a top end 822, a bottom end 824, a wall 842, and a bore that extends between the ends 822 and 824. The insert 802 can include a metal, such as a metal in elemental form (a single atomic species, such as Cu, W, Ti, Al, etc.), an alloy, or the like, such as steel or the like. In a particular embodiment, the insert 802 and wall 704 can have the same principal metal. For example, the insert 802 and the wall 704 may be different types of steel, yet both are principally iron.

In an embodiment, the insert 802 has a maximum outer width at the top end 822 that is no greater than 0.80 cm (0.31 inch), no greater than 0.70 cm (0.28 inch), or no greater than 0.60 cm (0.24 inch), and in another embodiment, the maximum outer width is at least 0.30 cm (0.12 inch), at least 0.40 cm (0.16 inch), at least 0.50 cm (0.20 inch). In a particular embodiment, the insert 802 has a maximum outer width in a range of 0.30 cm to 0.80 cm (0.12 inch to 0.31 inch), 0.40 cm to 0.70 cm (0.16 inch to 0.28 inch), or 0.50 to 0.60 cm (0.20 inch to 0.24 inch). Because the insert 802 is tapered, the insert 802 has a minimum outer width at the bottom end 824 that is different from the maximum outer width. In an embodiment, the insert 802 has a minimum outer width of no greater than 0.60 cm (0.24 inch), no greater than 0.55 cm (0.22 inch), or no greater than 0.50 cm (0.20 inch), and in another embodiment, the insert has a minimum outer width of at least 0.20 cm (0.08 inch), at least 0.30 cm (0.12 inch), at least 0.40 cm (0.16 inch). In a particular embodiment, the insert 802 has a minimum outer width in a range of 0.20 cm to 0.60 cm (0.08 inch to 0.24 inch), 0.30 cm to 0.55 cm (0.12 inch to 0.22 inch), or 0.40 to 0.50 cm (0.16 inch to 0.20 inch).

In an embodiment, the insert 802 has a maximum inner width at the top end 822 that is no greater than 0.40 cm (0.16 inch), no greater than 0.35 cm (0.14 inch), or no greater than 0.30 cm (0.12 inch), and in another embodiment, the maximum inner width is at least 0.15 cm (0.06 inch), at least 0.20 cm (0.08 inch), at least 0.25 cm (0.10 inch). In a particular embodiment, the insert 802 has a maximum inner width in a range of 0.15 cm to 0.40 cm (0.06 inch to 0.16 inch), 0.20 cm to 0.35 cm (0.08 inch to 0.14 inch), or 0.25 to 0.30 cm (0.10 inch to 0.12 inch). Because the insert 802 is tapered, the insert 802 has a minimum inner width at the bottom end 824 that is different from the maximum inner width. In an embodiment, the insert 802 has a minimum inner width of no greater than 0.20 cm (0.08 inch), no greater than 0.18 cm (0.07 inch), or no greater than 0.17 cm (0.06 inch), and in another embodiment, the insert has a minimum inner width of at least 0.07 cm (0.03 inch), at least 0.10 cm (0.04 inch), at least 0.13 cm (0.05 inch). In a particular embodiment, the insert 802 has a minimum outer width in a range of 0.07 cm to 0.20 cm (0.03 inch to 0.08 inch), 0.10 cm to 0.18 cm (0.04 inch to 0.07 inch), or 0.13 to 0.17 cm (0.05 inch to 0.06 inch).

The wall 824 of the insert 802 can have a wall thickness and a bore extending completely through the insert 802. In an embodiment, the wall thickness can be at least 0.05 cm (0.02 inch), at least 0.10 cm (0.04 inch), or at least 0.15 cm (0.06 inch), and in another embodiment, the wall thickness may be no greater than 0.030 cm (0.12 inch), no greater 0.25 cm (0.10 inch), or no greater 0.20 cm (0.08 inch). In a particular embodiment, the wall thickness is in a range of 0.05 cm to 0.30 cm (0.08 inch to 0.12 inch), 0.10 cm to 0.25 cm (0.04 inch to 0.10 inch), or 0.15 cm to 0.20 cm (0.06 inch to 0.08 inch).

The insert 802 can have an angle $\alpha$ (alpha) that is defined by an intersection of a line along the outer surface of the insert 802 and the centerline of the insert 802. The angle $\alpha$ can be less than 40°, less than 30°, or less than 15°, and in another embodiment, the angle $\alpha$ can be at least 4°, at least 5°, at least 7°, at least 9° or at least 10°. In a particular embodiment, the angle $\alpha$ is in a range of 4° to 30°, 5° to 20°, or 9° to 15°.

FIG. 9 illustrates an embodiment after the insert 802 is placed into the opening 120 of the ceramic tile 100. The top end 822 of the insert 802 lies at an elevation below the major surface 142 of the ceramic tile 100. If the elevational different is too small, there may not be sufficient room to add a sealant to the cover the opening 120. In an embodiment, as measured as a percentage of the depth of the opening in a direction from the major surface 144 to the major surface 142, the elevation of the top of the insert 802 will be at an elevation is at an elevation that is no greater than 95% of the depth, no greater than 90% of the depth, or greater then 85% of the depth of the opening. If the insert 802 does not extend sufficiently high enough along the depth of the opening 120, the ability to dissipate a thermal gradient when welding or other heat fastening technique may be insufficient. In another embodiment, the elevation of the top of the insert 802 will be at an elevation is at an elevation that is at least 40% of the depth, at least 45% of the depth, or at least 50% of the depth of the opening 120.

The bottom end 824 of the insert 802 may lie at the same elevation, or lie at an elevation within 0.2 mm (0.008 inch), within 0.4 mm (0.016 inch), within 0.9 mm (0.035 inch), within 1.3 mm (0.050 inch), within 1.8 mm (0.070 inch) above or below the major surface 144 of the ceramic tile. In a particular embodiment, the bottom end 824 of the insert 802 is spaced apart from the wall 704 to allow solder from a subsequent welding operation to flow under part of the insert 802

Figure 10:
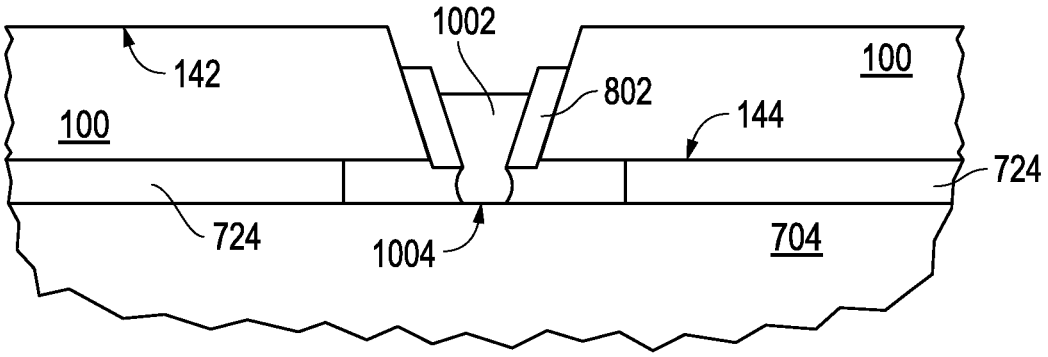
FIG. 10 includes an illustration of a cross-sectional view of the ceramic tile, insert, and mounting object of FIG. 9 after fastening the ceramic tile to the mounting object.

The method can further include fastening the ceramic tile to the mounting object, at block 608 in FIG. 6. Different methods can be used for fastening the ceramic tile 100 to the wall 704. Welding can be used to fasten the ceramic tile 100 to the wall 704. In the embodiment as illustrated in FIG. 10, solder 1002 is used during a welding operation to fasten the ceramic tile 100 to the wall 704. In particular, the solder 1002 contacts the wall 704 at region 1004. In a particular embodiment, the solder 1002 has good bonding characteristics with the wall 704 and the insert 802. When the insert 802 and wall 704 have the same principal metal or metals, the selection of welding solders may be greater than if the principal metals are different. For example, both the insert 802 and wall 704 can be steel, although they may be different types of steel. Thus in this case, the insert 802 and wall 704 have the same principle metals, namely steel. Some care may be needed in welding so that the ceramic tile 100 is not damaged during welding or so that the weld does not completely fill the opening 120 in the ceramic tile 100. For example, too high of a voltage during welding may cause too much heat to be transferred to the ceramic tile 100 can cause it to fracture, and too high of a solder feed rate may fill the opening. The particular voltage and feed rate during soldering can depend on the particular equipment and solder used. If ceramic tile shows signs of fracturing or similar stress, the welding voltage should be lowered. If the opening 120 is filled with too much solder, the solder feed rate should be reduced. Skilled welders will be able to determine parameters to use for welding for a particular application.

The solder may partly or completely fill the bore of the insert 802. A portion of the solder 1002 can flow such that portions are directly under the insert 802. Although the solder 1002 is illustrated as having a flat upper surface, the upper surface may be jagged or have other features. The solder 1002 may fill only part or substantially all of the bore of the insert 802. In an embodiment, the solder 1002 may fill at least 30%, at least 35% or at least 45% of the bore of the insert 802, and in another embodiment, the solder 1002 may fill no more than 95% of the bore, no greater than 90% of the bore of the insert 802. In still another embodiment, the solder 1002 may fill more than just the bore of the insert 802; however, a significant volume of the opening 120 remains so that a subsequent filling material can sufficiently protect the solder 1002 from particles that would flow along the major surface 142 of the ceramic tile 100. The solder 1002 may or may not contact the ceramic tile 100. Thus, the solder 1002 may extend to an elevation above the top end 822 of the insert 802; however, the solder 1002 does not extend to an elevation at or higher than the major surface 142 of the ceramic tile 100.

Figure 11:
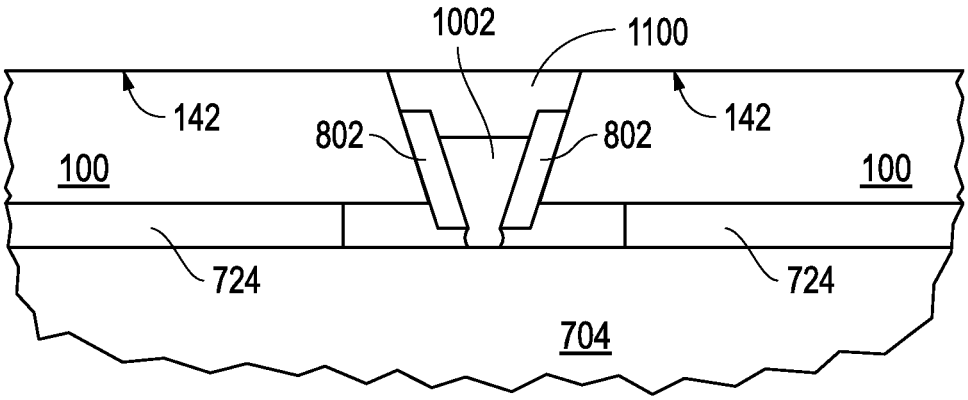
FIG. 11 includes an illustration of a cross-sectional view of a ceramic tile, insert, and mounting objection of FIG. 10 after filling a remaining portion of the opening of the ceramic tile with a polymer compound.

The method includes filling a remaining portion of the opening 120 in the ceramic tile 100 with a polymeric compound, at block 610 in FIG. 6. In the embodiment in FIG. 11, a polymeric compound 1100 is formed over the insert 802 and the solder 1002 to fill the remaining part of the opening 120. The polymeric compound 1100 has an exposed surface that is adjacent to the major surface 142 of the ceramic tile 100. In a particular embodiment, the exposed surface of the polymeric compound 1100 is at an elevation that lies along substantially the same plane as the major surface 142 of the ceramic tile. The polymeric compound 1100 can include an epoxy, a rubber compound, a polysiloxane, or the like. If static charge build-up is a concern, carbon or a metal (for example, silver filled epoxy) can be included within the polymeric compound 1100 to form an electrically conductive or electrically resistive path between the wall 704 and the ceramic tile 100.

Figure 12:
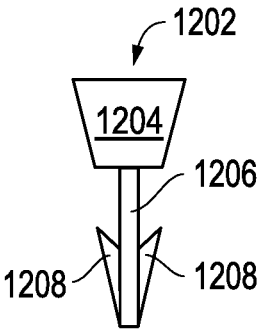
FIGS. 12 to 14 include illustrations of side views of inserts in accordance with alternative embodiments.

In other embodiments, other types of inserts and fastening techniques may be used. Particular embodiments may allow forming a hole extending into or through a mounting object, such as the wall 704, to which the ceramic tile is mounted. FIG. 12 includes an illustration of a side view of an insert 1202 that has a main body 1204 and a stem 1206 from which barbs 1208 extend. The barbs 1208 can be flexible so that the barbs 1208 deploy after passing through the wall 704. The main body 1204 can have the outer dimensions and height as previously described for the insert 802. The length of the stem 1206 and the position of the barbs 1208 will depend on the location and thickness of the wall 704 relative to the bottom of the main body 1204. The barbs 1208 can be located on the stem 1206 so that the barbs 1208 deploy at or close to the final position of the insert 1202 after fastening is completed. The stem 1206 and barbs 1208 may include a polymer. The main body 1204 can include the same or different polymer as the stem 1206 and barbs 1208. In another embodiment, the main body 1204 can include a metal.

Figure 13:
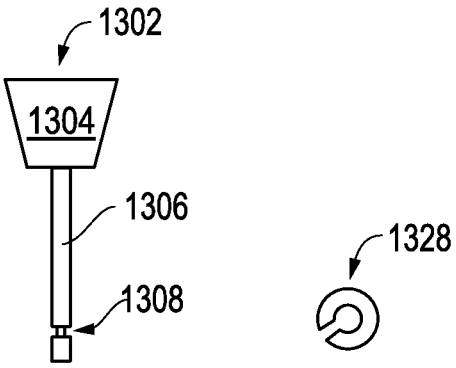
Figure 14:
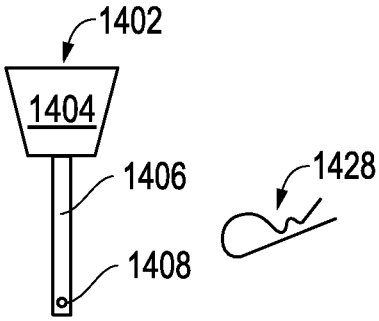

FIG. 13 includes another embodiment in which a combination of an insert 1302 and a retainer 1328 is used. The insert 1302 includes a main body 1304 and a stem 1306. A groove 1308 within the stem 1306 allows the retainer 1328 to be placed within the groove 1308. The retainer 1328 can be a retainer ring, such as a C-shaped ring. FIG. 14 includes a further embodiment in which a combination of an insert 1402 and a retainer 1428 is used. The insert 1402 includes a main body 1404 and a stem 1406. A hole 1408 within the stem 1406 allows part of the retainer 1428 to be placed into the hole 1408. The retainer 1428 can be a cotter pin, and a leg of the cotter pin can be inserted into the hole 1408. For the inserts 1302 and 1402, the main bodies 1204 and 1304 can have outer dimensions that have been previously described with respect to the insert 802. Each of the inserts 1302 and 1402 and the retainers 1328 and 1428 can be made of a polymer, a metal, or a combination of the two (for example, the main body can be a metal, and the stem can be a polymer; or the main body can be a polymer, and the stem can be a metal).

Figure 17:
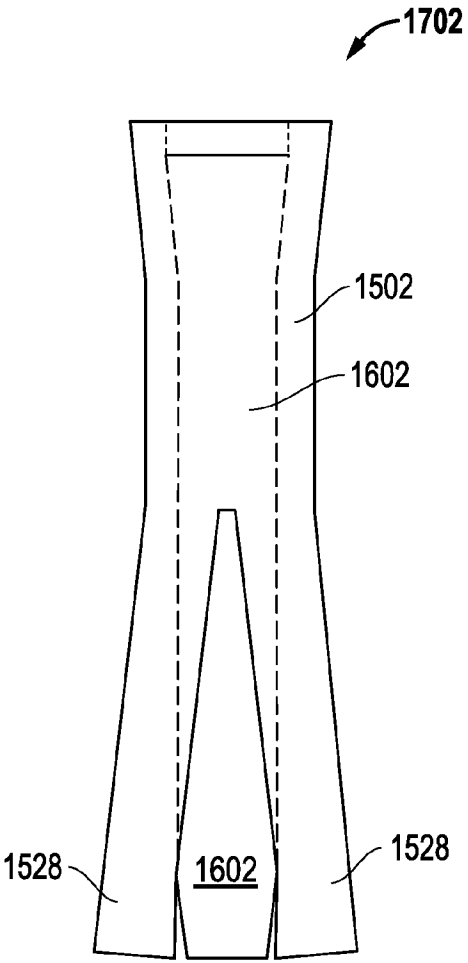
FIGS. 15 to 17 include illustrations of side view of components that can be mated to form an insert in accordance with an alternative embodiment.
Figure 16:
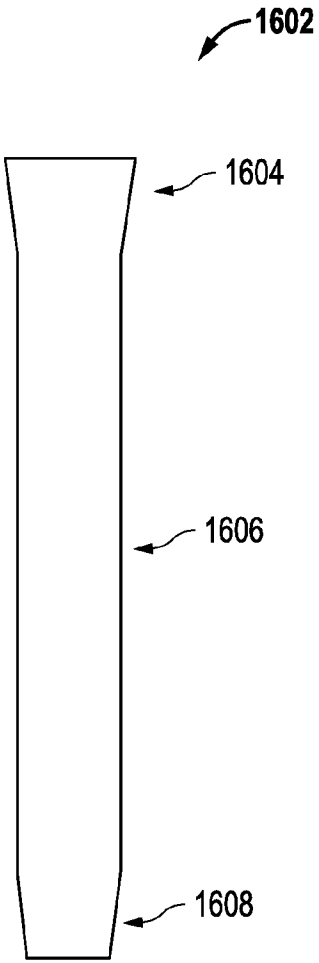
Figure 15:
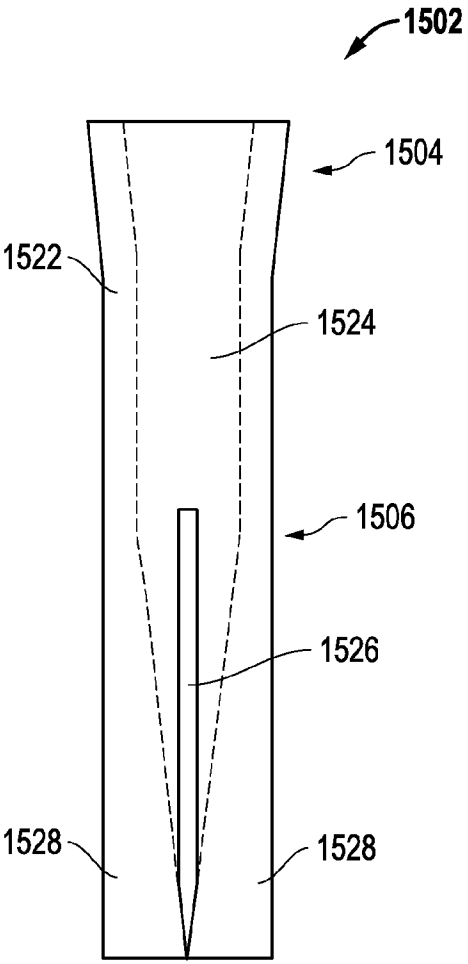

FIGS. 15 to 17 include another embodiment in which a combination of a body 1502 and a pin 1602 are used to form an insert 1702. The body 1502 includes a head 1504 and a stem 1506 having a proximal end adjacent to the head 1504 and a distal end opposite the proximal end. The head 1504 can be tapered, and the stem 1506 can have a substantially constant width (illustrated) or a width that slightly decreases towards the distal end of the stem 1506. The body 1502 has a wall 1522, the inner surface of which defines an opening 1524 that extends through the head 1504 and into the stem 1506. Within the stem 1506, the opening 1524 becomes narrower at a region closer to the distal end of the stem 1506. The opening 1524 can extend to the distal end of the stem 1506 or may terminate slightly before the distal end. The stem 1506 includes leg portions 1528 that define slit-shaped openings 1526 extending along parts of the stem 1506 adjacent to the distal end. The leg portions 1528 may or may not be connected to each other at the distal end. If the leg portions 1528 are connected, the leg portions 1528 may be frangibly connected to each other. The body 1502 can include 2, 3, 4, or more leg portions 1528.

FIG. 16 includes an illustration of a side view of the pin 1602 that has a head 1604 and a stem 1606 having a proximal end adjacent to the head 1604 and a distal end opposite the proximal end. The stem 1606 has a tapered portion 1608 adjacent to the distal end. The head 1604 has a shape that is complementary to the opening 1524 within the head 1504 of the body 1502. The stem 1604 has a substantially constant width (illustrated) or a width that slightly decreases before reaching the tapered portion 1528.

The pin 1602 can be inserted into the body 1502 to form the insert 1702, as illustrated in FIG. 17. As the pin 1602 is pushed into the opening 1524 of the body 1502, the pin 1602 reaches a point at which it causes the leg portions 1528 to splay open. If the leg portions 1528 were frangibly connected, the pin 1602 exerts sufficient force to break the frangible connections. After the leg portions 1528 are splayed, the body 1502 is wider at the head 1502 and the distal end of the stem 1506 than the proximal end of the stem 1506. The insertion of the pin 1602 can continue to be inserted into the opening 1524 until the head 1604 of the pin 1602 contacts the inner wall of the head 1504 of the body 1502. The top of the pin 1602 may be recessed within the opening 1524 of the body 1502 (illustrated) or may lie flush or slightly above the top surface of the body 1502.

Referring to the ceramic tile 100 and the wall 704, an opening in the wall can be formed and have the same or slightly larger dimension that the width of the stem 1506 before the leg portions 1528 are splayed. The body 1502 is inserted into the openings in the ceramic tile 100 and the wall 704. In an embodiment, the pin 1602 is inserted in the opening 1524 of the body 1502 after the body 1502 is inserted into the openings in the ceramic tile 100 and the wall 704. In another embodiment, the pin 1602 is partly inserted in the opening 1524 of the body 1502 before the body 1502 is inserted into the openings in the ceramic tile 100 and the wall 704. In this embodiment, the pin 1602 is not inserted so far that significant splaying of the leg portions 1528 has occurred. After the body 1502 in inserted into the openings of the ceramic tile 100 and wall 704, the pin 1602 can be inserted into the opening 1524 of the body 1502 to cause the leg portions 1528 to splay.

Each of the body 1502 and the pin 1602 can be made of a polymer, a metal, or a combination of the two (for example, the head 1502 can be a metal, and the pin 1602 can be a polymer; or the head 1502 can be a polymer, and the stem 1602 can be a metal).

Other designs can be used for the insert without departing from the scope of the concepts as described herein. The polymeric compound 1100 is used to fill the remaining part of the opening after fastening is completed.

When a ceramic tile has a plurality of openings, a plurality of inserts can be used. The plurality of inserts can have the any of the composition and dimensions as previously described. The inserts within the plurality inserts openings can be substantially identical or at least one insert can be different from another insert.

While the process of installing ceramic tiles has been described with respect to the ceramic tile 100, such processes and inserts used in fastening can be used with the ceramic tile 400 and many other designs of ceramic tiles.

Embodiments as describe herein provide benefits over conventional designs. When the width of the opening in the ceramic tile is too large, a cap may be used or the polymeric compound exposed at the opening in the ceramic tile may become too large. For a cap, an adhesive material is used to secure the cap to the ceramic tile. As particles pass along the surface of the ceramic tiles, the particles can erode the adhesive, and the cap can be removed by the particles. The fastener, such as a weld, may become exposed, and the particles may then start to abrade the fastener and compromise the fastener's strength, cause metal particles from the fastener to become entrained with the other particles, or both. If a cap is not used, a relatively large area of a polymer compound is exposed, and the relatively large area allows the polymer compound to abrade relatively faster and may cause the fastener to become exposed, similar to the cap being removed.

The relatively smaller size of the opening in the ceramic tile of embodiments as described above does not require a cap and less polymer compound is exposed at the opening, and thus, the polymer compound is abraded at a slower rate. The ceramic tile can be used for a longer period of particle flow before a fastener within the opening becomes exposed. Therefore, the ceramic tile can be installed for a longer service life.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the items as listed below.

Item 1. A ceramic product comprising a ceramic tile having a front surface and a back surface opposite the front surface, wherein the front surface is configured to be exposed when installed, and defining a first opening extending through an entire thickness of the ceramic tile, wherein the first opening has a sidewall includes a tapered portion, and the first opening has a maximum width of no greater than 1.15 cm.

Item 2. The ceramic product of Item 1, further comprising an insert that has an outer surface that complements an inner surface within the tapered portion of the first opening.

Item 3. A method of installing a ceramic tile comprising:

providing a ceramic tile having a front surface and a back surface opposite the front surface, wherein the ceramic tile defines a first opening extending through an entire thickness of the ceramic tile, positioning the ceramic tile at a desired location with respect to a mounting surface of a mounting object, such that the back surface of the ceramic tile faces the mounting surface;

fastening the ceramic tile to the mounting object using a non-threaded fastener; and after fastening the ceramic tile to the mounting object, filling a remaining portion of the first opening with a polymeric compound.

Item 4. The method of Item 3, further comprising placing an insert into the first opening before fastening the ceramic tile to the mounting object.

Item 5. The method of Item 3 or 4, wherein fastening the ceramic tile comprises welding the ceramic tile to the mounting object using a welding compound, wherein a portion of the welding compound lies within a tapered portion of the first opening.

Item 6. The method of Item 5, wherein the insert is thermally conductive and helps to dissipate heat during welding to reduce a thermal gradient within the ceramic tile as compared to not having an insert.

Item 7. The ceramic product or method of any one of Items 2 and 4 to 6, wherein the insert has a maximum outer width no greater than 0.80 cm, no greater than 0.70 cm, or no greater than 0.60 cm.

Item 8. The ceramic product or method of any one of Items 2 and 4 to 7, wherein the insert has a maximum outer width of at least 0.30 cm, at least 0.40 cm, at least 0.50 cm.

Item 9. The ceramic product or method of any one of Items 2 and 4 to 8, wherein the insert has a maximum outer width in a range of 0.30 cm to 0.80 cm, 0.40 cm to 0.70 cm, or 0.50 to 0.60 cm.

Item 10. The ceramic product or method of any one of Items 2 and 4 to 7, wherein the insert has a minimum outer width of no greater than 0.60 cm, no greater than 0.55 cm, or no greater than 0.50 cm.

Item 11. The ceramic product or method of any one of Items 2 and 4 to 10, wherein the insert has a minimum outer width of at least 0.20 cm, at least 0.30 cm, at least 0.40 cm.

Item 12. The ceramic product or method of any one of Items 2 and 4 to 11, wherein the insert has a minimum outer width in a range of 0.20 cm to 0.60 cm, 0.30 cm to 0.55 cm, or 0.40 to 0.50 cm.

Item 13. The ceramic product or method of any one of Items 2 and 4 to 12, wherein an angle defined by the outer surface and a centerline of the insert is less than 40°, less than 30°, or less than 15°.

Item 14. The ceramic product or method of any one of Items 2 and 4 to 13, wherein an angle defined by the outer surface and a centerline of the insert is at least 4°, at least 5°, at least 7° at least 9° or at least 10°.

Item 15. The ceramic product or method of any one of Items 2 and 4 to 14, wherein an angle defined by the outer surface and a centerline of the insert is in a range of 4° to 30°, 5° to 20°, or 9° to 15°.

Item 16. The ceramic product or method of any one of Items 2 and 4 to 15, wherein the insert has a wall thickness and a bore extending completely through the insert.

Item 17. The ceramic product or method of Item 16, wherein the wall thickness is at least 0.05 cm, at least 0.10 cm, or at least 0.15 cm.

Item 18. The ceramic product or method of Item 16 or 17, wherein the wall thickness is no greater than 0.030 cm, no greater 0.25 cm, or no greater 0.20 cm.

Item 19. The ceramic product or method of any one of Items 16 to 18, wherein the wall thickness is in a range of 0.05 cm to 0.30 cm, 0.10 cm to 0.25 cm, or 0.15 cm to 0.20 cm.

Item 20. The method of Item 3, wherein fastening the ceramic tile to the mounting object comprises:

providing an insert having a head portion and a stem portion that has a deployable feature; and inserting the stem portion through a wall of the mounting object such that the deployable feature deploys after passing through the wall, such that at least part of the head portion of the insert is disposed within the first opening.

Item 21. The method of Item 3, wherein fastening the ceramic tile to the mounting object comprises:

providing an insert having a head portion and a stem portion that has a groove or a hole;

inserting the stem portion through a wall of the mounting object such that the groove or the hole passes through the wall; and on a side of the wall opposite the ceramic tile, attaching a retainer to the insert at the groove or the hole of the insert.

Item 22. The method of Item 21, wherein the stem portion has a groove, and the retainer includes a retaining ring.

Item 23. The method of Item 21, wherein the stem portion has a hole, and the retainer includes a cotter pin.

Item 24. The ceramic product or method of any one of Items 2 and 4 to 23, wherein the insert that has an outer surface that complements an inner surface within a tapered portion of the first opening.

Item 25. The ceramic product or method of any one of Items 2 and 4 to 24, wherein the insert comprises a metal.

Item 26. The ceramic product or method of any one of Items 3 to 25, wherein the polymeric compound comprises an epoxy.

Item 27. The method of any one of Items 3 to 26, further comprising attaching the ceramic tile to the mounting object.

Item 28. The method of Item 27, wherein attaching is performed using an adhesive.

Item 29. The method of Item 27 or 28, wherein fastening the ceramic tile to the mounting object is performed after attaching the ceramic tile to the mounting object.

Item 30. The method of any one of Items 3 to 29, wherein the first opening has a sidewall that includes a tapered portion.

Item 31. The ceramic product or method of any one of Items 1, 2, and 30, wherein the tapered portion extends along substantially an entire depth of the first opening.

Item 32. The ceramic product or method of any one of Items 1, 2, and 30, wherein the first opening further includes a straight portion, wherein the back surface is closer to the tapered portion than the straight portion, and the front surface is closer to the straight portion than the tapered portion.

Item 33. The ceramic product or method of Item 32, wherein as compared to the straight portion, the tapered portion extends over a greater depth of the first opening.

Item 34. The ceramic product or method of any one of the preceding Items, wherein the first opening has a maximum width is no greater than 1.15 cm, no greater than 0.90 cm, no greater than 0.80 cm, or no greater than 0.70 cm.

Item 35. The ceramic product or method of any one of the preceding Items, wherein the first opening has a maximum width is at least 0.30 cm, at least 0.40 cm, at least 0.50 cm.

Item 36. The ceramic product or method of any one of the preceding Items, wherein the first opening has a maximum width is in a range of 0.30 cm to 0.90 cm, 0.40 cm to 0.80 cm, or 0.50 to 0.70 cm.

Item 37. The ceramic product or method of any one of the preceding Items, wherein the first opening has a minimum width of no greater than 0.80 cm, no greater than 0.70 cm, or no greater than 0.60 cm.

Item 38. The ceramic product or method of any one of the preceding Items, wherein the first opening has a minimum width of at least 0.20 cm, at least 0.30 cm, at least 0.40 cm.

Item 39. The ceramic product or method of any one of the preceding Items, wherein the first opening has a minimum width in a range of 0.20 cm to 0.80 cm, 0.30 cm to 0.70 cm, or 0.40 cm to 0.60 cm.

Item 40. The ceramic product or method of any one of the preceding Items, wherein the ceramic tile has a thickness no greater than 1.3 cm, no greater than 0.95 cm, no greater than 0.80 cm, or no greater than 0.70 cm.

Item 41. The ceramic product or method of any one of the preceding Items, wherein the ceramic tile has a thickness of at least 0.20 cm, at least 0.30 cm, and at least 0.60 cm.

Item 42. The ceramic product or method of any one of the preceding Items, wherein the ceramic tile has a length>width>thickness, wherein the length is at least 1.2 cm, at least 2.5 cm, at least 5.0 cm, at least 10 cm, or at least 15 cm.

Item 43. The ceramic product or method of any one of the preceding Items, wherein the ceramic tile has a length>width>thickness, wherein the length is no greater than 30 cm, no greater than 25 cm, or no greater than 20 cm.

Item 44. The ceramic product or method of any one of the preceding Items, wherein the ceramic tile has a length>width>thickness, wherein the width is at least 1.2 cm, at least 2.0 cm, at least 3.0 cm, or at least 4.0 cm.

Item 45. The ceramic product or method of any one of the preceding Items, wherein the ceramic tile has a length>width>thickness, wherein the width is no greater than 10 cm, no greater than 9 cm, or no greater than 7 cm.

Item 46. The ceramic product or method of any one of the preceding Items, wherein an angle defined by the outer surface and a centerline of the tapered portion of the first opening lies an at angle that is less than 40°, less than 30°, or less than 15°.

Item 47. The ceramic product or method of any one of the preceding Items, wherein an angle defined by the outer surface and a centerline of the tapered portion of the first opening lies at an angle that is at least 7°, at least 9°, at least 10°.

Item 48. The ceramic product or method of any one of the preceding Items, wherein an angle defined by the outer surface and a centerline of the tapered portion of the first opening lies an at angle that is in a range of 7° to 30°, 9° to 20°, or 10° to 15°.

Item 49. The ceramic product or method of any one of the preceding Items, wherein the ceramic tile comprises a plurality of openings substantially identical to the first opening.

Item 50. A process of forming a ceramic tile comprising:

combining a ceramic precursor powder with a binder;

shaping a combination of the ceramic precursor powder and the binder to form a green body; and firing the green body to form the ceramic tile having a front surface and a back surface opposite the front surface, wherein the front surface is configured to be exposed when installed, wherein the ceramic tile defines a first opening extending through an entire thickness of the ceramic tile, wherein from the first opening has a sidewall includes a tapered portion, and the first opening has a maximum width of no greater than 1.15 cm.

Item 51. The process of Item 50, further comprising removing a portion of the green body to form the first opening after shaping and before firing the green body.

Item 52. The process of Item 50, wherein shaping the combination of the ceramic precursor powder and the binder forms the green body having the opening.

Item 53. The process of Item 51 or 52, wherein shaping is performed using a mould.

Item 54. The process of any one of Items 51 to 53, wherein the first opening in the green body has a tapered portion that extends along substantially an entire depth of the first opening.

Item 55. The process of Item 54, wherein the first opening in the green body further includes a straight portion, wherein the back surface is closer to the tapered portion than the straight portion, and the front surface is closer to the straight portion than the tapered portion.

Item 56. The process of Item 55, wherein as compared to the straight portion, the tapered portion extends over a greater depth of the first opening.

Item 57. The process of any one of Items 51 to 56, wherein the first opening in the green body has a maximum width of the first opening in the green body, wherein the maximum width is no greater than 0.90 cm, no greater than 0.80 cm, or no greater than 0.70 cm.

Item 58. The process of any one of Items 51 to 57, wherein the first opening in the green body has a maximum width of the first opening in the green body, wherein the maximum width is at least 0.30 cm, at least 0.40 cm, at least 0.50 cm.

Item 59. The process of any one of Items 51 to 58, wherein the first opening in the green body has a maximum width of the first opening in the green body, wherein the maximum width is in a range of 0.30 cm to 0.90 cm, 0.40 cm to 0.80 cm, or 0.50 to 0.70 cm.

Item 60. The process of any one of Items 51 to 59, wherein the first opening in the green body has a minimum width of the first opening in the green body, wherein the minimum width is no greater than 0.80 cm, no greater than 0.70 cm, or no greater than 0.60 cm.

Item 61. The process of any one of Items 51 to 60, wherein the first opening in the green body has a minimum width of the first opening in the green body, wherein the minimum width is at least 0.20 cm, at least 0.30 cm, at least 0.40 cm.

Item 62. The process of any one of Items 51 to 61, wherein the first opening in the green body has a minimum width of the first opening in the green body, wherein the minimum width is in a range of 0.20 cm to 0.80 cm, 0.30 cm to 0.70 cm, or 0.40 to 0.60 cm.

Item 63. The process of any one of Items 51 to 62, wherein the green body comprises a plurality of openings substantially identical to the first opening.

Item 64. The process of any one of Items 51 to 63, wherein an angle defined by the outer surface and a centerline of the tapered portion of the first opening in the green body lies an at angle that is less than 40°, less than 30°, or less than 15°.

Item 65. The process of any one of Items 51 to 64, wherein an angle defined by the outer surface and a centerline of the tapered portion of the first opening in the green body lies at an angle that is at least 4°, at least 5°, at least 7°, at least 9°, at least 10°.

Item 66. The process of any one of Items 51 to 65, wherein an angle defined by the outer surface and a centerline of the tapered portion of the first opening in the green body is in a range of 4° to 30°, 5° to 20°, or 9° to 15°.

Item 67. The process of Item 50, further comprising removing a portion of the ceramic tile to form the first opening after firing the green body.

Item 68. The process of any one of Items 50 to 67, wherein the green body has a thickness no greater than 1.3 cm, no greater than 0.95 cm, no greater than 0.80 cm, or no greater than 0.70 cm.

Item 69. The process of any one of Items 50 to 68, wherein the green body has a thickness of at least 0.20 cm, at least 0.30 cm, and at least 0.60 cm.

Item 70. The process of any one of Items 50 to 69, wherein the green body has a length>width>thickness, wherein the length is at least 2.5 cm, at least 5.0 cm, at least 10 cm, or at least 15 cm.

Item 71. The process of any one of Items 50 to 70, wherein the green body has a length>width>thickness, wherein the length is no greater than 30 cm, no greater than 25 cm, or no greater than 20 cm.

Item 72. The process of any one of Items 50 to 71, wherein the green body has a length≥width>thickness, wherein the width is at least 1.2 cm, at least 2.0 cm, at least 3.0 cm, or at least 4.0 cm.

Item 73. The process of any one of Items 50 to 72, wherein the green body has a length≥width>thickness, wherein the width is no greater than 10 cm, no greater than 9 cm, or no greater than 7 cm.

Item 74. The ceramic product, method, or process of any one of the preceding Items, wherein the ceramic tile includes at least 50 wt %, at least 65 wt %, or at least 80 wt % of $Al_2O_3$, $SiO_2$, $ZrO_2$, SiC, or any combination thereof.

Item 75. The ceramic product, method, or process of any one of the preceding Items, wherein the ceramic tile comprises at least 80 wt % of $Al_2O_3$, at least 85 wt % of $Al_2O_3$, at least 90 wt % of $Al_2O_3$, or at least 95 wt % of $Al_2O_3$.

Item 76. The ceramic product, method, or process of Item 74 or 75, wherein the ceramic tile further comprises at least 0.1 wt % of an additive, at least 0.4 wt % of the additive, or at least approximately 0.6 wt % of the additive.

Item 77. The ceramic product, method, or process of any one of Items 74 to 76, wherein the ceramic tile comprises no greater than 8 wt % of an additive, no greater than approximately 7 wt % of the additive, or no greater than approximately 6 wt % of the additive.

Item 78. The ceramic product, method, or process of 76 or 77, wherein the additive comprises a sintering agent.

Item 79. The ceramic product, method, or process of Item 78, wherein the sintering agent comprises Ta, Ti, Fe, Mg, Zn, or any combination thereof.

Item 80. The ceramic product, method, or process of any one of Items 75 to 79, further comprising $SiO_2$.

Item 81. The ceramic product, method, or process of Item 80, wherein the ceramic tile further comprises an additive that substantially prevents Al from reacting with the $SiO_2$.

Item 82. The ceramic product, method, or process of Item 81, wherein the additive comprises Mg, Ca, Ba, Sr, Y, or any combination thereof.

Item 83. The ceramic product, method, or process of any one of the preceding Items, wherein the ceramic tile or the green body has a shape in a form of a planar tile, a curved tile, a pyramid, or a cone.

Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Certain features, that are for clarity, described herein in the context of separate embodiments, may also be provided in combination in a single embodiment. Conversely, various features that are, for brevity, described in the context of a single embodiment, may also be provided separately or in a subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. An apparatus comprising:

a mounting object having a mounting surface;

a ceramic tile:

having a front surface and a back surface opposite the front surface, wherein the back surface is closer to the mounting surface than the front surface; and defining a first opening extending through an entire thickness of the ceramic tile, wherein the first opening has a sidewall including a tapered portion and a maximum width of no greater than 1.15 cm;

a non-threaded fastener within a portion of the first opening and having a proximal end, a distal end, and a bore extending completely through the non-threaded fastener, wherein:

the proximal end is closer to the mounting surface than the distal end;

the non-threaded fastener comprises an insert extending beyond the back surface of the tile such that the proximal end of the non-threaded fastener is closer to the mounting surface than the back surface of the tile and comprises a welding compound under the insert; and an inner wall of the non-threaded fastener defining the bore is linear through the bore in a cross-sectional view of the non-threaded fastener, wherein a cap is not included in the first opening.

2. The apparatus of claim 1, wherein the first opening has a maximum width of no greater than 0.90 cm.

3. The apparatus of claim 1, further comprising a polymer filled in all remaining portion of the first opening and adjacent to the distal end.

4. The apparatus of claim 3, wherein the polymer comprises an epoxy, a rubber compound, a polysiloxane, or a combination thereof.

5. The apparatus of claim 1, wherein a wall thickness of the non-threaded fastener is constantly uniform along a depth of the bore.

6. The apparatus of claim 5, further comprising a welding compound placed in the bore of the non-threaded fastener.

7. The apparatus of claim 1, wherein the non-threaded fastener has an outer surface that complements an inner surface within the tapered portion of the first opening.

8. The apparatus of claim 1, wherein the non-threaded fastener comprises a thermally conductive material.

9. The apparatus of claim 1, wherein the non-threaded fastener extends within the first opening for at least 40% to not greater than 90% of a depth of the first opening.

10. The apparatus of claim 1, wherein the insert has a maximum outer width at least 0.30 cm and no greater than 0.80 cm.

11. The apparatus of claim 1, wherein the first opening further includes a straight portion, wherein the back surface is closer to the tapered portion than the straight portion and the front surface is closer to the straight portion than the tapered portion.

12. The apparatus of claim 1, wherein the tapered portion extends along substantially an entire depth of the first opening.

13. A method of installing a ceramic tile comprising:

providing a ceramic tile having a front surface and a back surface opposite the front surface, wherein the ceramic tile defines a first opening extending through an entire thickness of the ceramic tile, and the first opening has a maximum width of no greater than 1.15 cm, positioning the ceramic tile at a desired location with respect to a mounting surface of a mounting object, such that the back surface of the ceramic tile faces the mounting surface;

placing a fastener into a portion of the first opening, wherein the fastener comprises an insert extending beyond the back surface of the tile such that an end of the insert is closer to the mounting surface than the back surface of the tile and comprises a welding compound under the insert;

fastening the ceramic tile to the mounting object, wherein fastening comprises welding the fastener to the mounting surface; and filling all remaining portion of the first opening with a polymer after fastening the ceramic tile to the mounting object.

14. The method of claim 13, wherein the fastener comprises a bore extending completely through the fastener.

15. The method of claim 14, wherein fastening comprises placing the welding compound in the bore of the fastener.

16. The method of claim 15, wherein the welding compound flows such that a portion of the welding compound is directly under the fastener.

17. The method of claim 15, wherein the welding compound fills at least 30% and no more than 95% of the bore.

18. The method of claim 15, wherein the polymeric comprises an electrically conductive or electrically resistive material.

19. The method of claim 15, wherein the fastener is thermally conductive and helps to dissipate heat during welding to reduce a thermal gradient within the ceramic tile.

20. The method of claim 15, wherein the fastener is non-threaded.

* * * * *